US009297186B2

(12) United States Patent
Chen et al.

(10) Patent No.: US 9,297,186 B2
(45) Date of Patent: Mar. 29, 2016

(54) LOCK ASSEMBLIES FOR TELECOMMUNICATIONS ENCLOSURES

(75) Inventors: Simon Shen-Meng Chen, Palatine, IL (US); Jerome Maloney, Sugar Grove, IL (US)

(73) Assignee: Emerson Network Power, Energy Systems, North America, Inc., Warrenville, IL (US)

( * ) Notice: Subject to any disclaimer, the term of this patent is extended or adjusted under 35 U.S.C. 154(b) by 557 days.

(21) Appl. No.: 13/250,170

(22) Filed: Sep. 30, 2011

(65) Prior Publication Data

US 2013/0082583 A1 Apr. 4, 2013

(51) Int. Cl.

| | |
|---|---|
| ***E05C 1/12*** | (2006.01) |
| *E05B 35/00* | (2006.01) |
| *E05B 15/10* | (2006.01) |

(52) U.S. Cl.

CPC . *E05C 1/12* (2013.01); *E05B 15/10* (2013.01); *E05B 35/008* (2013.01); *Y10T 292/0977* (2015.04); *Y10T 292/1016* (2015.04)

(58) Field of Classification Search

CPC ..... E05C 1/12; E05B 15/10
USPC ..... 292/169; 361/679.57
See application file for complete search history.

(56) References Cited

U.S. PATENT DOCUMENTS

| | | | | |
|---|---|---|---|---|
| 5,481,890 | A * | 1/1996 | Millman | E05B 3/065 292/336.3 |
| 6,038,894 | A * | 3/2000 | Hu | 70/224 |
| 6,598,949 | B2 * | 7/2003 | Frazier | H02G 9/10 174/38 |
| 7,357,009 | B2 * | 4/2008 | Maloney | E05B 17/002 174/135 |
| 7,569,768 | B2 * | 8/2009 | Maloney | H02G 3/0493 174/38 |
| 7,975,515 | B2 * | 7/2011 | Ygnelzi | E05B 13/001 109/52 |
| 2005/0103780 | A1 * | 5/2005 | Maloney | H02G 9/10 220/4.02 |
| 2010/0079041 | A1 * | 4/2010 | Chen | H04B 1/3888 312/100 |
| 2010/0239210 | A1 * | 9/2010 | Wakileh | G02B 6/4466 385/55 |

* cited by examiner

*Primary Examiner* — Zachary M Pape
*Assistant Examiner* — Douglas Burtner
(74) *Attorney, Agent, or Firm* — Harness, Dickey & Pierce, P.L.C.

(57) ABSTRACT

A lock assembly is provided for releasably coupling a dome of a telecommunications enclosure to a base of the telecommunications enclosure. The lock assembly generally includes a housing having at least one stop, a slider disposed at least partly within the housing and moveable between an extended position for coupling the dome of the telecommunications enclosure to the base of the telecommunications enclosure and a retracted position for uncoupling the dome from the base, and a cam configured to rotate and move the slider between the retracted position and the extended position. The cam is engageable with the at least one stop of the housing to stop rotation of the cam when the slider moves to the retracted position and/or to stop rotation of the cam when the slider moves to the extended position.

29 Claims, 5 Drawing Sheets

LOCK ASSEMBLIES FOR TELECOMMUNICATIONS ENCLOSURES

FIELD

The present disclosure generally relates to lock assemblies and, in particular, to lock assemblies for telecommunications enclosures.

BACKGROUND

This section provides background information related to the present disclosure which is not necessarily prior art.

Telecommunications enclosures are commonly used in the telecommunications industry to house connections and/or components. The telecommunications enclosures are often employed to distribute telecommunications services, e.g., telephone, television, radio, computer network, internet, etc., to one or more customer locations. The telecommunications enclosures are often locked to discourage unauthorized access. In addition, when installed in outdoor environments, the telecommunications enclosures are generally required to resist harsh conditions associated with the outdoor environment in order to protect one or more connections and/or components contained therein.

SUMMARY

This section provides a general summary of the disclosure, and is not a comprehensive disclosure of its full scope or all of its features.

In one aspect of the present disclosure, a lock assembly is provided for use, for example, for releasably coupling a dome of a telecommunications enclosure to a base of the telecommunications enclosure. The lock assembly generally includes a housing having at least one stop, a slider disposed at least partly within the housing and moveable between an extended position for coupling the dome of the telecommunications enclosure to the base of the telecommunications enclosure and a retracted position for uncoupling the dome from the base, and a cam configured to rotate and move the slider between the retracted position and the extended position. The cam is engageable with the at least one stop of the housing to stop rotation of the cam when the slider moves to the retracted position and/or to stop rotation of the cam when the slider moves to the extended position.

In another aspect of the present disclosure, a telecommunications enclosure generally includes a dome, a base for receiving the dome, and a lock assembly for coupling the dome to the base. The lock assembly generally includes a housing coupled to one of the dome and the base and having at least one stop, a slider disposed at least partly within the housing and moveable between an extended position for coupling the dome to the base and a retracted position for uncoupling the dome from the base, and a cam configured to rotate and move the slider between the retracted position and the extended position. The at least one stop of the housing is configured to limit the rotation of the cam moving the slider to the retracted position and/or to limit the rotation of the cam moving the slider to the extended position to thereby help inhibit damage to the lock assembly resulting from torque caused by the rotation of the cam.

In still another aspect of the present disclosure, a telecommunications enclosure generally includes a dome, a base for receiving the dome, and a lock assembly for coupling the dome to the base. The lock assembly generally includes a housing coupled to one of the dome and the base and having at least one stop, a slider disposed at least partly within the housing and moveable between an extended position for coupling the dome to the base and a retracted position for uncoupling the dome from the base, a cam configured to rotate within the housing and move the slider between the retracted position and the extended position, and at least one resilient member configured to bias the slider toward the extended position. The at least one stop of the housing includes an arcuate flange extending orthogonally away from the housing and through a rotational angle of about ninety degrees. The cam includes at least one protrusion moveable within a channel defined by the housing adjacent to the flange of the at least one stop of the housing when the cam rotates to move the slider between the retracted position and the extended position. The at least one stop of the housing stops the rotation of the cam when the slider reaches the retracted position and/or stops the rotation of the cam when the slider reaches the extended position to thereby help inhibit damage to the lock assembly resulting from torque caused by the rotation of the cam.

In another aspect of the present disclosure, a lock assembly is provided for use, for example, for releasably coupling a dome of a telecommunications enclosure to a base of the telecommunications enclosure. Here, the lock assembly generally includes a housing having a platform configured to receive at least one secondary locking device and/or at least one security device, a slider disposed at least partly within the housing and moveable between an extended position for coupling the dome of the telecommunications enclosure to the base of the telecommunications enclosure and a retracted position for uncoupling the dome from the base, and a cam configured to rotate and move the slider between the retracted position and the extended position. The platform of the housing is configured to align with at least part of the telecommunications enclosure so that the at least one secondary locking device and/or the at least one security device, when received by the platform, can be used to help couple and/or secure the dome of the telecommunications enclosure to the base of the telecommunications enclosure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
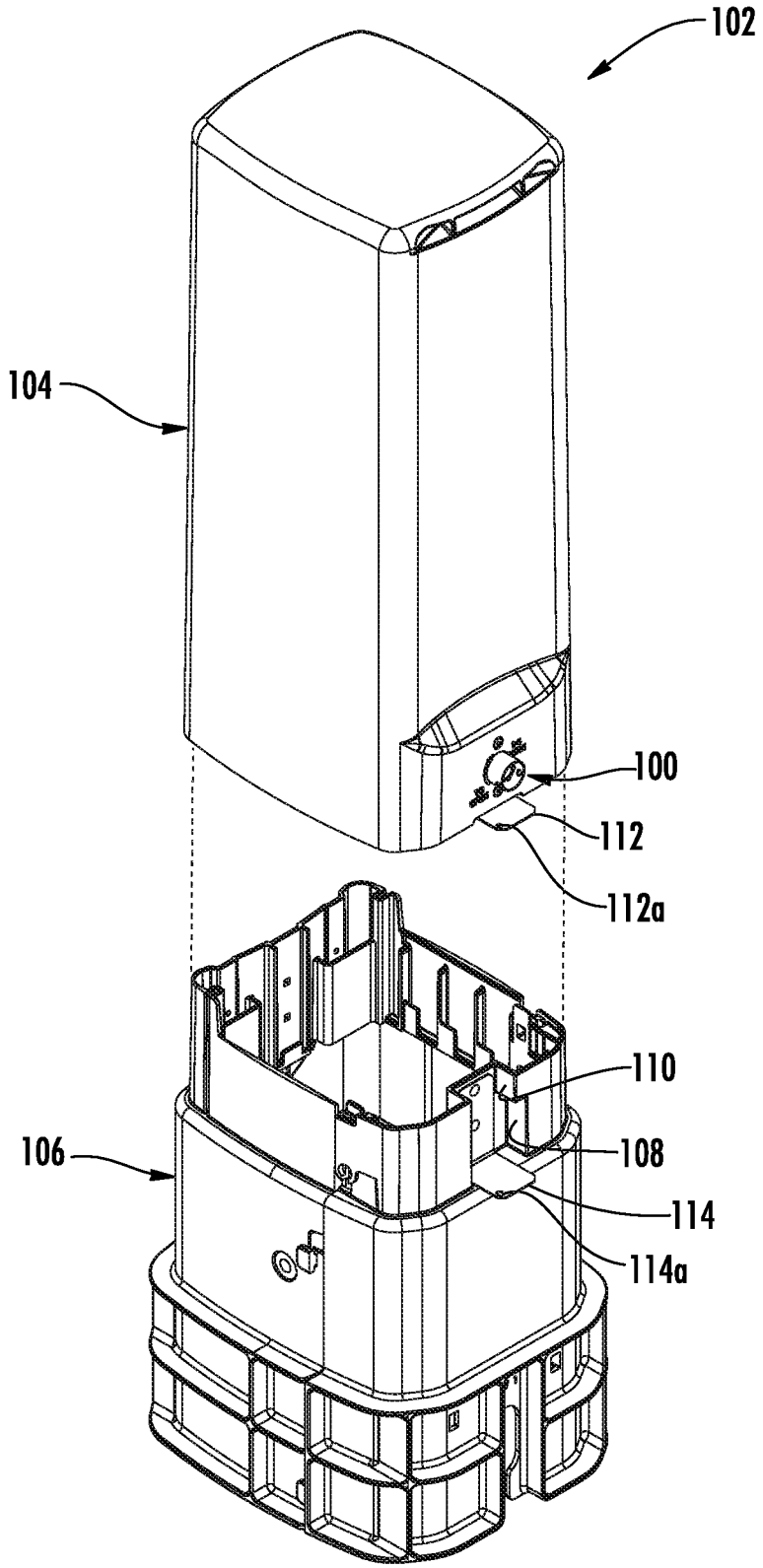
FIG. 1 is an exploded perspective view of a telecommunications enclosure including a lock assembly according to one example embodiment of the present disclosure installed thereto.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure generally relates to lock assemblies. The lock assemblies can be used with telecommunications enclosures and can operate to selectively secure the enclosures in closed positions to help inhibit and/or discourage unauthorized, etc. access into the enclosures. Telecommunications enclosures in which the lock assemblies may be installed include, for example, pedestals, outdoor enclosures, utility/power closures, other desired enclosures, etc.

A lock assembly of the present disclosure may include a housing, a slider disposed at least partly within the housing, and a cam configured to move the slider between an extended position and a retracted position. In the extended position, the slider operates to secure an enclosure (to which the lock assembly is installed) in a closed position. In the retracted position, the slider allows the enclosure to be opened. In some aspects, at least one resilient member may be included to urge the slider to automatically move to the extended position (e.g., providing a self-locking feature, an automatic locking feature, etc.). As such, the lock assembly may be configured so that a minimum torque is required (e.g., at least about thirty inch-pounds of torque, at least about fifty inch-pounds of torque, etc.) to operate the cam to move the slider (e.g., from the extended position to the retracted position to over come the resilient member, etc.).

A lock assembly of the present disclosure may also include a housing configured to be coupled to a portion of an enclosure. A slider is then operable to selectively secure the enclosure in a closed position through engagement with another portion of the enclosure. The slider may be configured to move linearly between a retracted position and an extended position to secure the enclosure in the closed position. Or, the slider may be configured to rotate, or move in any other desired fashion, between the retracted position and the extended position to secure the enclosure in the closed position.

Any suitable tools (e.g., manual tools, electric tools, pneumatic tools, etc.) may be used to access and rotate the cams of lock assemblies of the present disclosure to effect movement of the sliders. For example, a standard tool such as a 216 tool having a seven-sixteenth inch hex head capable of applying about thirty to about fifty inch-pounds of torque to the cams may be used. Or a more complex tool may be used, for example, having a different head (for a drive style having more complexity) and/or capable of applying greater than about fifty inch-pounds of torque to the cams.

Some lock assemblies of the present disclosure are configured to protect, insulate, etc. internal components of the lock assemblies from torque applied to the lock assemblies when opening and/or closing the assemblies. For example, the lock assemblies are configured to inhibit damage to the lock assemblies resulting from excess rotational torque, over-torque, etc. applied to cams of the lock assemblies when opening and/or closing the assemblies.

As an example, such a lock assembly may include a housing having at least one stop configured to stop, control, limit, etc. rotational movement of a cam operating to open and/or close the lock assembly. For example, the cam is free to rotate relative to the stop to open and/or close the lock assembly (via torque applied to the cam). But the stop is positioned so that the cam engages the stop once the lock assembly opens or once the lock assembly closes. Additional movement of the cam is prevented by the stop, and any additional torque applied to the cam is directed toward (and absorbed by) the stop and not internal components (e.g., the cam, the slider, etc.) of the lock assembly. The stop can include any suitable structure such as, for example, a recess, a lip, a ridge, a flange, etc. and can have any suitable shape for interacting with the cam.

Such a lock assembly may also include a cam having at least one protrusion and a housing having at least one stop configured to stop, control, limit, etc. rotational movement of the cam operating to open and/or close the lock assembly via engagement with the protrusion. The cam is free to rotate relative to the stop to open and/or close the lock assembly (via torque applied to the cam). But the stop is positioned so that the protrusion of the cam engages the stop once the lock assembly opens or once the lock assembly closes. The cam may include other suitable structure (e.g., structure other than a protrusion, etc.) for interacting with the stop.

Some lock assemblies of the present disclosure are configured to accommodate secondary locking devices and/or security devices (e.g., padlocks, devices indicating that the lock assembly and/or an enclosure to which the lock assembly is installed has been opened by unauthorized users, etc.). In these lock assemblies, the secondary locking devices and/or security devices may be used (in combination with the lock assemblies) to help selectively secure the enclosures in closed positions to help inhibit and/or discourage unauthorized, etc. access into the enclosures and/or indicate when unauthorized access has occurred. In some aspects, these lock assemblies (while not required) may also be configured to protect, insulate, etc. internal components of the lock assemblies from torque applied to the lock assemblies when opening and/or closing the assemblies (as previously described).

As an example, such a lock assembly may include a platform (e.g., integrated with the lock assembly, etc.) for adding at least one secondary locking device and/or at least one security device to the lock assembly. When the lock assembly is installed to an enclosure and the enclosure is in the closed position, the secondary lock and/or the security device can be coupled to the lock assembly platform and to an aligned portion of the enclosure to help selectively secure the enclosures in the closed position to help inhibit and/or discourage unauthorized, etc. access into the enclosure and/or indicate when unauthorized access has occurred.

Example embodiments of lock assemblies of the present disclosure will now be described more fully with reference to the accompanying drawings.

Figure 2:
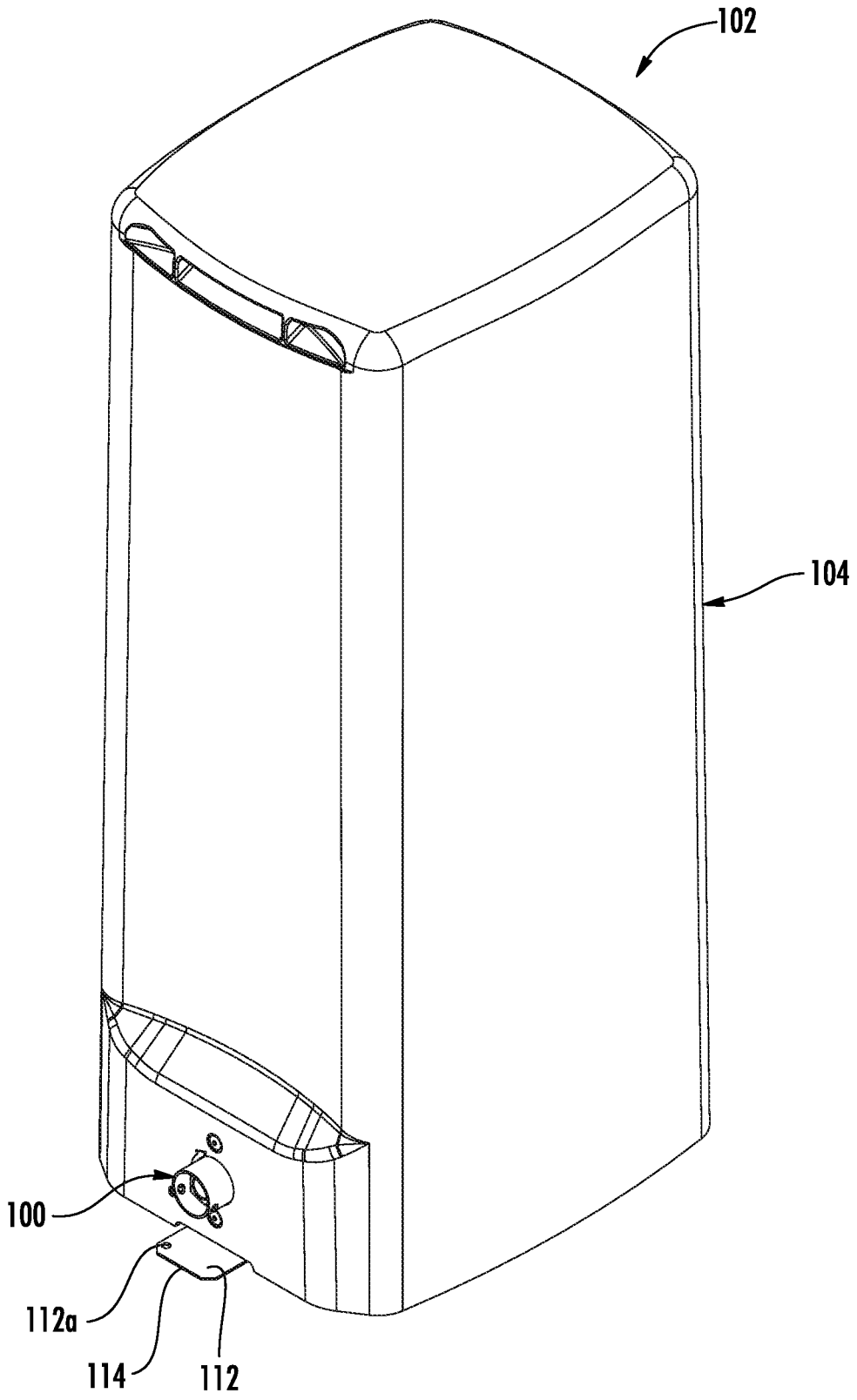
FIG. 2 is a perspective view of the telecommunications enclosure of FIG. 1 shown in a closed position.

FIGS. 1 and 2 illustrate one example embodiment of a lock assembly 100 of the present disclosure. The lock assembly 100 is shown installed to a telecommunications enclosure 102. The illustrated telecommunications enclosure 102 includes a dome 104, a base 106 for receiving the dome 104, and the lock assembly 100 for selectively coupling (e.g., securing, etc.) the dome 104 to the base 106. The illustrated dome 104 is substantially monolithic in construction which, for example, can help provide flood protection to connections and/or components (not shown) housed within the dome 104 (and base 106).

In the illustrated embodiment, the lock assembly 100 is coupled to a lower portion of the dome 104. The base 106 includes a recess 108 positioned to generally align with the lock assembly 100 when the dome 104 is received on the base 106. A slider (not visible) of the lock assembly 100 is configured to extend into the recess 108, under a lip portion 110 of the base 106, to couple the dome 104 to the base 106. Thus, when the dome 104 is positioned over the base 106 and lowered onto the base 106 (FIG. 2), the slider can be moved (e.g., automatically (via resilient members, etc.) as described in more detail with regard to lock assembly 200, etc.) into the recess 108 of the base 106, under the lip portion 110, to secure the dome 104 to the base 106. In this closed position, the lock assembly 100 operates to help inhibit and/or discourage unauthorized, etc. access into the telecommunications enclosure 102.

The illustrated lock assembly 100 also includes a platform 112 that can be used to add secondary locking devices (e.g., padlocks, etc.) and/or security devices (e.g., alligator clips, devices indicating that the telecommunications enclosure 102 has been opened by unauthorized users, etc.) to the lock assembly 100. For example, when the telecommunications enclosure 102 is in the closed position, the lock assembly platform 112 generally aligns with a plateau 114 of the base 106. A secondary lock and/or a security device (not shown) can then be coupled to the platform 112 and the plateau 114 (e.g., via aligned openings 112*a*, 114*a*, etc.). The platform 112 can be integrally formed with the lock assembly or separately coupled thereto (e.g., see FIGS. 3-6 in which platform 212 is integrally formed as part of base 232, etc.). Thus, the platform 112 can allow for integrating, embedding, etc. at least one secondary lock and/or at least one security device into the lock assembly 100 so that dual security can be provided.

In other embodiments, lock assemblies can alternatively be coupled to bases of telecommunications enclosures. Here, domes of the telecommunications enclosures can include recesses positioned to generally align with the lock assemblies when the domes are received on the bases. Sliders of the lock assemblies can then be extended into the recesses of the domes (e.g., under lip portions of the domes, etc.) to thereby couple the domes to the bases.

FIGS. 3-6 illustrate a lock assembly 200 according to another example embodiment of the present disclosure. The lock assembly 200 of this embodiment can also be used with an enclosure (e.g., the telecommunications enclosure 102 illustrated in FIGS. 1 and 2, etc.) to help secure the enclosure in a closed position, as desired. As such, the lock assembly 200 can help inhibit and/or discourage unauthorized, etc. access into the enclosure.

Figure 4:
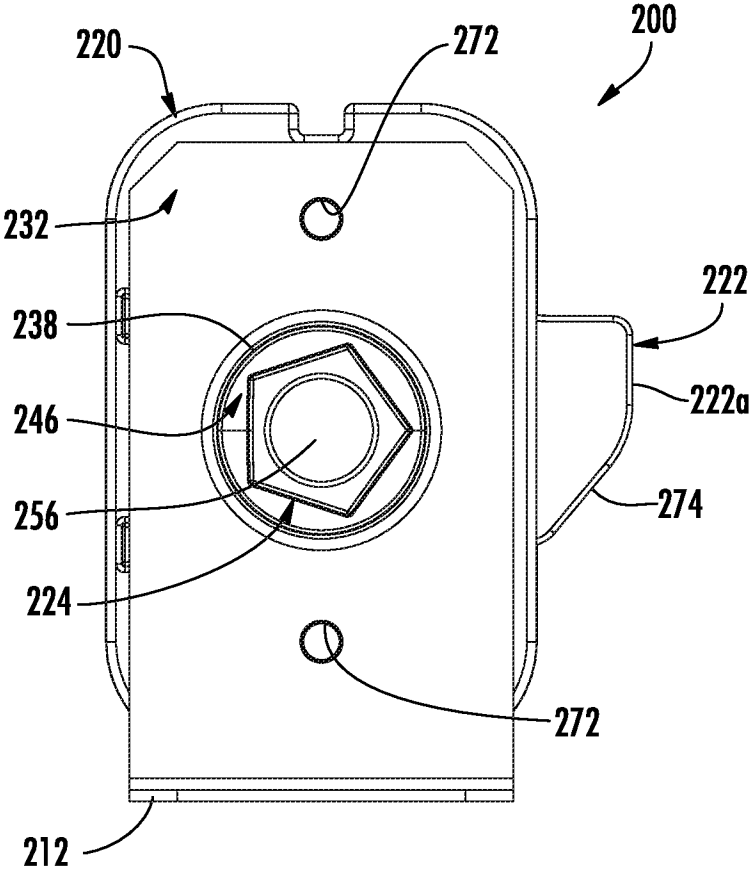
FIG. 4 is a forward elevation view of the lock assembly of FIG. 3.
Figure 3:
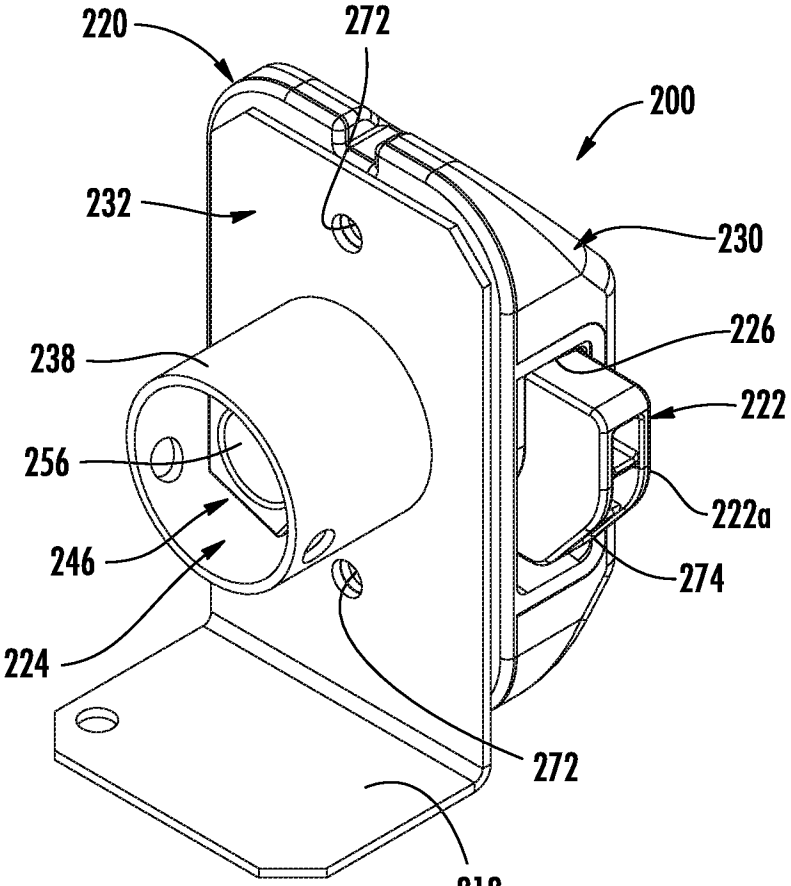
FIG. 3 is a perspective view of a lock assembly according to another example embodiment of the present disclosure.

As shown in FIGS. 3 and 4, the lock assembly 200 generally includes a housing 220, a slider 222 positioned within the housing 220, and a cam 224 coupled to the slider 222 to effect movement of the slider 222 relative to the housing 220. The cam 224 is configured to rotate to move the slider 222 between an extended position (FIGS. 3 and 4) and a retracted position (not shown). In the extended position, an end portion 222*a* of the slider 222 projects from an opening 226 of the housing 220. In the retracted position, the end portion 222*a* of the slider 222 is positioned substantially within the opening 226 of the housing 220. In the illustrated embodiment, rotation of the cam 224 in a clockwise direction moves the slider 222 from the extended position to a retracted position. And, rotation of the cam 224 in a counter-clockwise direction moves the slider 222 from the retracted position to the extended position. However, other operational configurations may be applied to effect movement of the slider 222.

Figure 6:
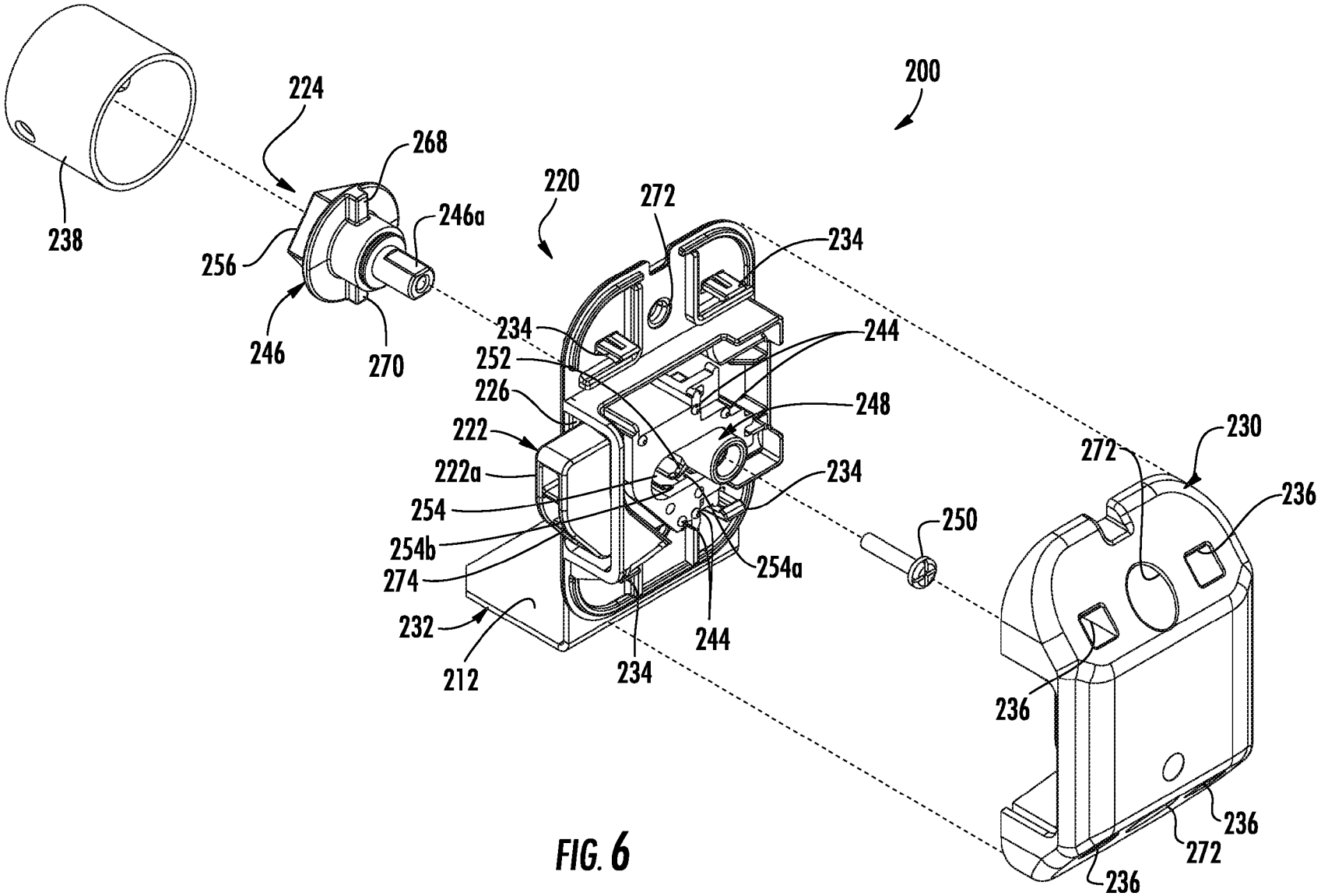
FIG. 6 is a rearward, exploded perspective view of the lock assembly of FIG. 3.

The illustrated housing 220 includes a cover 230 and a base 232 coupled together via suitable fasteners (e.g., snap fasteners, screws, rivets, bolts, nails, adhesive, welds, other mechanical fasteners, etc.). In the illustrated embodiment, the cover 230 and base 232 are coupled together via snap-fit fasteners 234 integrally formed with the base 232 (FIG. 6). An opening 236 in the cover 230 (FIG. 6) is associated with each of the fasteners 234. After the cover 230 and base 232 are snapped together, plugs (not shown) are inserted into the cover openings 236 to form an interference fit and seal the openings 236 to help prevent ingress of debris (e.g., mud, dirt, sand, water, particulates, etc.). The cover 230 and base 232 may further be sealed together via gaskets, etc. (see U.S. Patent Application Publication No. US 2010/0079041, the entire disclosure of which is incorporated herein by reference) to additionally help prevent ingress of debris into the lock assembly 200. In other embodiments, housings may instead be provided with single piece constructions to help inhibit ingress of debris into the housings.

The illustrated base 232 includes a platform 212 that can be used to add secondary locking devices (e.g., padlocks, etc.) and/or security devices (e.g., alligator clips, devices indicating that an enclosure to which the lock assembly 200 is installed has been opened by unauthorized users, etc.) to the lock assembly 200.

Additionally in the illustrated embodiment, a shroud 238 is provided coupled to the base 232 of the housing 220 to protect the cam 224 and/or resist access by unauthorized users thereto (e.g., resist access using unauthorized tools, etc.). In other embodiments, different shroud configurations may be employed—with or without drain grooves—to protect cams and/or resist access by unauthorized users. Alternatively, shrouds may be omitted from lock assemblies.

In FIGS. 3 and 4, the slider 222 is shown in the extended position, with the end portion 222*a* of the slider 222 extending out of the housing 220. Resilient members (not visible) such as, for example, compression springs, etc. (see U.S. Patent Application Publication No. US 2010/0079041, the entire disclosure of which is incorporated herein by reference) are located within the housing 220 to urge, bias, etc. the slider 222 toward (and generally hold the slider 222 in) this extended position. As such, when the lock assembly 200 is installed to an enclosure, the resilient members can help hold the slider 222 in the extended position and the enclosure in a closed position. The resilient members resist movement of the slider 222 from the extended position to the retracted position (and thus resist the counter-clockwise movement of the cam 224). As such, a minimum amount of toque (e.g., at least about twenty inch-pounds of torque, at least about fifty inch-pounds of torque, etc.) must be applied to the cam 224 to move the slider 222 from the extended position to the retracted position (to overcome the resistance of the resilient members (e.g., to compress, etc. the resilient members to allow movement of the slider 222 to the retracted position)). In other embodiments, lock assemblies may include only one resilient member, or no resilient members.

Figure 5:
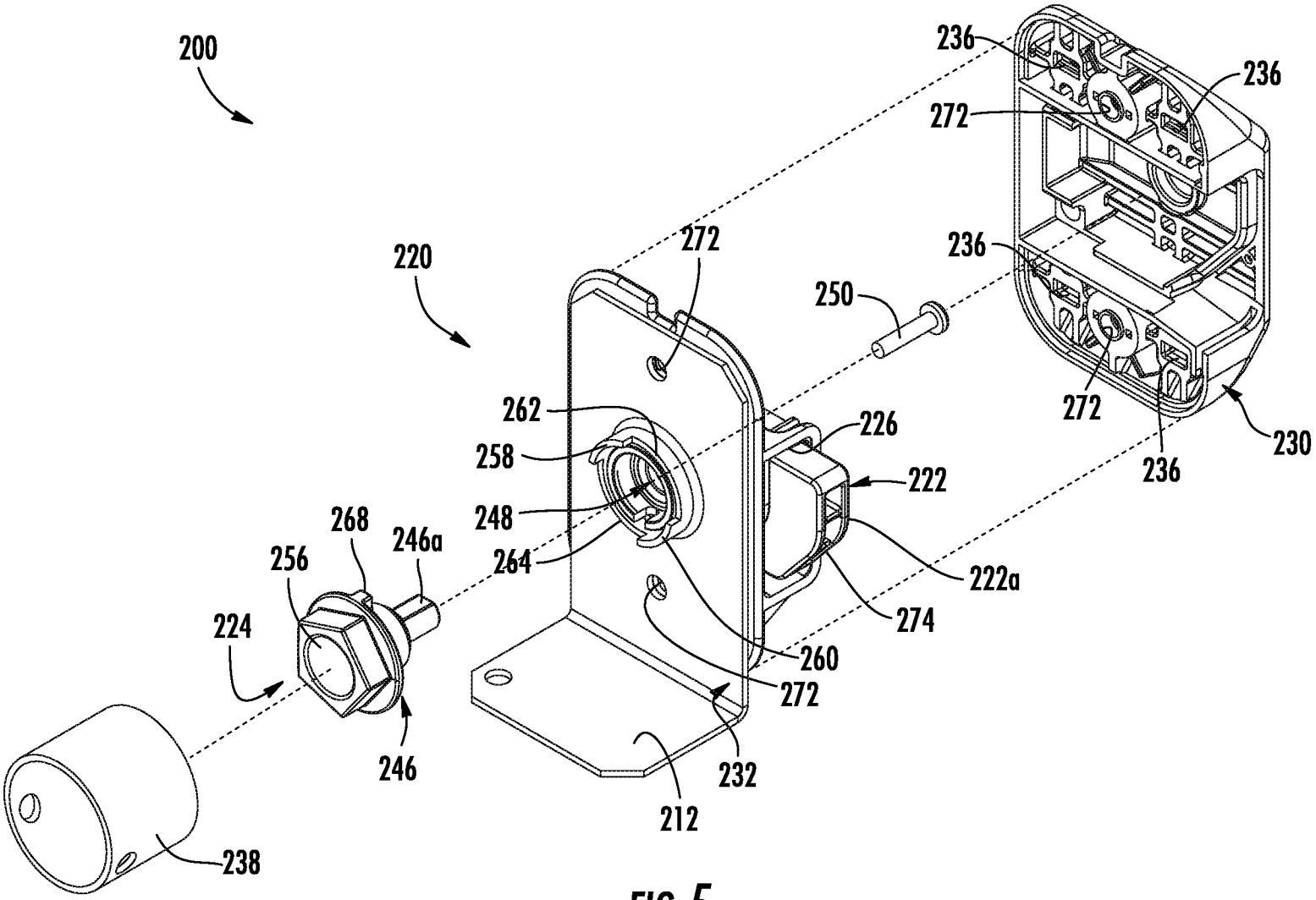
FIG. 5 is a forward, exploded perspective view of the lock assembly of FIG. 3.

With additional reference now to FIGS. 5 and 6, the illustrated slider 222 includes multiple protrusions 244 (FIG. 6) for contacting internal surfaces of the cover 230 and base 232 of the housing 220. The protrusions 244 are located on both a rearward side portion of the slider 222 (FIG. 6) and a forward side portion of the slider 222 (not visible). Contact between the protrusions 244 and the cover 230 and base 232 inhibit flush surface contact between the slider 222 and the housing 220. In this manner, debris may be disposed in or fall through spaces between the housing 220 and the slider 222 without substantially affecting movement of the slider 222 relative to the housing 220. In other embodiments, protrusions may be included on one or both of sliders and covers and/or bases of housings to limit or reduce surface contact between the sliders and the housings. In still other embodiments, sliders may include no protrusions.

It should be appreciated that sliders having different configurations (e.g., sizes, shapes, structures, etc.) may be employed in different embodiments, possibly depending on configurations of enclosures to be closed by the lock assemblies, etc. In addition, sliders that rotate, or move differently than disclosed herein, may be used.

The cam 224 includes a drive head 246 and a translator 248. The drive head 246 couples to the translator 248, via a keyed end portion 246*a* and a fastener 250, so that rotation of the drive head 246 correspondingly rotates the translator 248. The translator 248 includes a tab 252 that fits into an opening 254 of the slider 222. Rotation of the translator 248 (via the drive head 246) moves the tab 252 into engagement with side portions 254*a*, 254*b* of the opening 254, which in turn linearly translates the slider 222. For example, clockwise rotation of the cam 224 and translator 248 moves the tab 252 into engagement with side portion 254*a*, which in turn linearly translates the slider 222 from the extended position to the retracted position. And, counter-clockwise rotation of the cam 224 and translator 248 moves the tab 252 into engagement with side portion 254*b*, which in turn linearly translates the slider 222 from the retracted position to the extended position (if needed). In other embodiments, cams may have configurations different than illustrated herein for effecting movement of sliders (e.g., different shapes of drive heads and/or translators, different tab configurations of translators, different couplings between drive heads and translators, one-piece, unitary constructions of drive heads and translators, etc.).

The illustrated drive head 246 of the cam 224 includes a head portion 256 having a penta-head drive style. This unique drive style is configured to be engaged by a tool (e.g., a manual tool, an electric tool, a pneumatic tool, etc.) having a corresponding drive style to thereby allow the tool to receive the head portion 256 and rotate the cam 224 to effect movement of the slider 222. In other embodiments, cams may include head portions with different drive styles than illustrated herein. For example, cam head portions can alternatively have hex-head drive styles; non-standard, special, and/or proprietary drive styles (such that special tools provided by manufacturers may be required to efficiently rotate the cams); etc.

With continued reference to FIGS. 5 and 6, the housing 220 further includes stops 258, 260 configured to stop, control, limit, etc. the rotation of the cam 224 moving the slider 222 to the retracted position and to the extended position. This helps inhibit damage to the lock assembly 200 resulting from torque (e.g., excessive torque, etc.) caused by the rotation of the cam 224 (e.g., torque applied to the cam 224 by a tool, etc.). For example, the cam 224 is free to rotate relative to the stops 258, 260 to open and close the lock assembly 200 (via torque applied to the cam 224). But the stops 258, 260 are positioned so that the cam 224 engages the stops 258, 260 once the lock assembly 200 opens or once the lock assembly 200 closes. Additional movement of the cam 224 is prevented by the stops 258, 260, and any additional torque applied to the cam 224 is directed toward (and absorbed by, received by, etc.) the stops 258, 260 (and not internal components of the lock assembly 200 such as, for example, the cam 224, the slider 222, etc.).

As an example, typical tools used to open lock assemblies, such as a 216 tool having a seven-sixteenth inch hex head, apply about thirty to about fifty inch-pounds of torque to cams of the lock assemblies. More complex tools, however, may be used particularly where (as in the instant lock assembly 200) different, unique drive styles are provided on head portions of the cams. These more complex tools, however, can apply significantly more torque to the cams of the lock assemblies (e.g., intentionally, unintentionally, under the same input from a user, etc.), greater than about fifty inch-pounds of torque to the cams. The stops 258, 260 of the housing 220 in the illustrated embodiment are configured to accommodate the greater torque and insulate the lock assembly 200 from possible internal damage resulting from use of these more complex tools.

The illustrated stops 258, 260 each extend generally orthogonally away from the housing 220. In addition, each stop 258, 260 is arcuate in shape and each extends through a rotational angle of about ninety degrees. Channels 262, 264 extend between each of the stops 258, 260, and each channel 262, 264 is also arcuate in shape and each also extends through a rotational angle of about ninety degrees. Protrusions 268, 270 of the cam 224 are received within the respective channels 262, 264 and move therein as the cam 224 rotates and moves the slider 222 (the channels 262, 264 thus operate to control travel of the cam 224). As such, the cam 224 is able to rotate about ninety degrees (or about one-quarter of a turn) to effect movement of the slider 222 between the extended position and the retracted position. After rotating about ninety degrees, however, the protrusions 268, 270 engage the stops 258, 260. For example, when the slider 222 reaches the extended position, protrusion 268 engages stop 258 and protrusion 270 engages stop 260, and the stops 258, 260 absorb any further torque applied to the cam 224. And when the slider 222 reaches the retracted position, protrusion 268 engages stop 260 and protrusion 270 engages stop 258, and the stops 258, 260 absorb any further torque applied to the cam 224.

In the illustrated embodiment, the stops 258, 260 are each defined by a flange extending generally orthogonally away from the housing 220 and having an arcuate shape. In other embodiments, however, stops may include and/or be defined by different shapes, structures, etc. configured to stop, control, limit, etc. the rotation of cams. In addition, while the housing 220 of the illustrated embodiment includes two stops 258, 260 and the cam 224 of the illustrated embodiment includes two protrusions 268, 270, other embodiments may include housings with one stop or more than two stops and/or cams with no protrusions, one protrusion, or more than two protrusions. Further, in some embodiments lock assemblies may include stops configured to only stop, control, limit, etc. the rotation of cams in one direction, for example, when moving sliders from the extended position to the retracted position, or when moving sliders from the retracted position to the extended position.

As previously stated, the lock assembly 200 may be used with the telecommunications enclosure 102 illustrated in FIGS. 1 and 2 (or, for that matter, with any other desired enclosure). In such use, the housing 220 of the lock assembly 200 can be coupled to the dome 104 of the enclosure 102, with the cam 224 (and shroud 238) positioned through an opening in the dome 104 to provide access to a user. The cover 230 and base 232 of the lock assembly 200 include two aligned holes 272 each for receiving a fastener for coupling the lock assembly 200 to the dome 104.

The resilient members of the lock assembly 200 position the slider 222 in the extended position. When the dome 104 is positioned over the base 106 and lowered onto the base 106, the end portion 222*a* of the slider 222 initially engages the lip portion 110 of the base 106. The lip portion 110 of the base 106, though, gradually biases the slider 222 toward the retracted position (via engagement with ramp surface 274 of the slider 222 and against the resisting force of the resilient members) until the slider 222 is clear to move by the lip portion 110. Continued movement of the dome 104 onto the base 106 moves the slider 222 past the lip portion 110 of the base 106. The slider 222 then automatically moves (via the resilient members) to the extended position with the end portion 222*a* of the slider 222 disposed in the recess 108 of the base 106, under the lip portion 110. Here, the lock assembly 200 secures the enclosure in a closed position.

With the telecommunications enclosure 102 in the closed position, the dome 104 is not removable from the base 106 unless acted upon by another force. For example, a tool can be used to rotate the cam 224 and move the slider 222 from the extended position to the retracted position. The slider 222 would thus retract out of the recess 108 and allow the dome 104 to be uncoupled from the base 106. In the illustrated embodiment, the required tool would have a drive style configured to receive the unique head portion 256 of the cam 224 and rotate the cam 224 to move the slider 222. The required tool would also be capable of applying sufficient torque to the cam 224 to overcome the bias of the resilient members.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A telecommunications enclosure comprising:

a dome;

a base for receiving the dome; and a lock assembly for releasably coupling the dome of the telecommunications enclosure to the base of the telecommunications enclosure, the lock assembly comprising a housing having at least one stop including a flange extending generally orthogonally away from the housing, a slider defining an opening and disposed at least partly within the housing and moveable between an extended position for coupling the dome of the telecommunications enclosure to the base of the telecommunications enclosure and a retracted position for uncoupling the dome from the base, and a cam including a translator having a tab positioned in the opening of the slider, a drive head coupled to the translator, and at least one protrusion for engaging the at least one stop, the drive head configured to rotate the translator such that the tab engages the slider to thereby move the slider between the retracted position and the extended position, wherein the at least one protrusion is engageable with the at least one stop of the housing to stop rotation of the translator when the slider moves to the retracted position and/or to stop rotation of the translator when the slider moves to the extended position.

2. The telecommunications enclosure of claim 1, wherein the at least one stop of the housing includes two stops, and wherein the at least one protrusion of the cam moves within at least one channel defined between the two stops when moving the slider between the retracted position and the extended position.

3. The telecommunications enclosure of claim 2, wherein the at least one protrusion of the cam includes two protrusions and the at least one channel defined between the two stops of the housing includes two channels, and wherein one of the two protrusions moves within one of the two channels and the other of the two protrusions moves within the other of the two channels when moving the slider between the retracted position and the extended position.

4. The telecommunications enclosure of claim 1, wherein the drive head is configured to rotate the translator in a first direction to move the slider from the extended position to the retracted position and in a second direction opposite the first direction to move the slider from the retracted position to the extended position, and wherein the at least one stop of the housing is configured to stop the rotation of the translator in the first direction when the slider reaches the retracted position and/or to stop the rotation of the translator in the second direction when the slider reaches the extended position.

5. The telecommunications enclosure of claim 4, wherein the at least one stop of the housing includes two stops each configured to stop the rotation of the translator in the first direction when the slider reaches the retracted position and/or to stop the rotation of the translator in the second direction when the slider reaches the extended position.

6. The telecommunications enclosure of claim 1, wherein the flange of the at least one stop is arcuate in shape and has an angular distance of about ninety degrees.

7. The telecommunications enclosure of claim 1, wherein the at least one stop is a first stop and wherein the housing includes a second stop having a flange extending generally orthogonally away from the housing, and wherein each flange is arcuate in shape and has an angular distance of about ninety degrees.

8. The telecommunications enclosure of claim 7, wherein the housing defines two channels extending between the flanges of the first stop and the second stop, each channel is arcuate in shape and has an angular distance of about ninety degrees, and wherein each channel allows the translator to rotate to move the slider between the retracted position and the extended position.

9. The telecommunications enclosure of claim 1, wherein the at least one stop of the housing is configured to stop the rotation of the translator when the slider reaches the retracted position and/or stop the rotation of the translator when the slider reaches the extended position to thereby help inhibit damage to the lock assembly resulting from torque caused by the rotation of the drive head.

10. The telecommunications enclosure of claim 1, wherein the housing includes a platform configured to receive at least one secondary locking device and/or at least one security device, and wherein the platform of the housing is configured to align with at least part of the telecommunications enclosure so that the at least one secondary locking device and/or the at least one security device, when received by the platform, can be used to help couple and/or secure the dome of the telecommunications enclosure to the base of the telecommunications enclosure.

11. The telecommunications enclosure of claim 1, further comprising at least one resilient member configured to bias the slider toward the extended position.

12. The telecommunications enclosure of claim 1, wherein the housing of the lock assembly is coupled to one of the dome and the base of the telecommunications enclosure.

13. A telecommunications enclosure comprising:

a dome;

a base for receiving the dome; and a lock assembly for coupling the dome to the base, the lock assembly including a housing coupled to one of the dome and the base and having at least one stop, the at least one stop including a flange extending generally orthogonally away from the housing, a slider defining an opening and disposed at least partly within the housing and moveable between an extended position for coupling the dome to the base and a retracted position for uncoupling the dome from the base, and a cam including a translator having a tab positioned in the opening of the slider, a drive head coupled to the translator, and at least one protrusion for engaging the at least one stop, the drive head configured to rotate the translator such that the tab engages the slider to thereby move the slider between the retracted position and the extended position, wherein the at least one stop of the housing is configured to limit the rotation of the translator when the slider is in the retracted position and/or to limit the rotation of the translator when the slider is in the extended position to thereby help inhibit damage to the lock assembly resulting from torque caused by the rotation of the drive head.

14. The telecommunications enclosure of claim 13, wherein the at least one protrusion is configured stop the rotation of the translator when the translator moves the slider of the lock assembly to the retracted position and/or when the translator moves the slider to the extended position.

15. The telecommunications enclosure of claim 14, wherein the at least one stop of the lock assembly housing includes two stops, and wherein the at least one protrusion of the cam moves within at least one channel defined between the two stops when moving the slider of the lock assembly between the retracted position and the extended position.

16. The telecommunications enclosure of claim 13, wherein the translator of the lock assembly rotates in a first direction to move the slider of the lock assembly from the extended position to the retracted position and in a second direction opposite the first direction to move the slider from the retracted position to the extended position, and wherein the at least one stop of the lock assembly housing is configured to stop the rotation of the translator in the first direction when the slider reaches the retracted position and/or to stop the rotation of the cam in the second direction when the slider reaches the extended position.

17. The telecommunications enclosure of claim 13, wherein the flange is arcuate in shape and has an angular distance of about ninety degrees.

18. The telecommunications enclosure of claim 13, wherein the at least one stop is a first stop and wherein the housing includes a second stop having a flange extending generally orthogonally away from the housing of the lock assembly, and wherein each flange is arcuate in shape and has an angular distance of about ninety degrees.

19. A telecommunications enclosure comprising:

a dome;

a base for receiving the dome; and a lock assembly for coupling the dome to the base, the lock assembly including a housing coupled to one of the dome and the base and having at least one stop, the at least one stop including an arcuate flange extending orthogonally away from the housing and having an angular distance of about ninety degrees, a slider disposed at least partly within the housing and moveable between an extended position for coupling the dome to the base and a retracted position for uncoupling the dome from the base, a cam configured to rotate within the housing and move the slider between the retracted position and the extended position, the cam having at least one protrusion moveable within a channel defined by the housing adjacent to the flange of the at least one stop of the housing when the cam rotates to move the slider between the retracted position and the extended position, and at least one resilient member configured to bias the slider toward the extended position, wherein the at least one stop of the housing stops the rotation of the cam when the slider reaches the retracted position and/or stops the rotation of the cam when the slider reaches the extended position to thereby help inhibit damage to the lock assembly resulting from torque caused by the rotation of the cam.

20. A telecommunications enclosure comprising:

a dome;

a base for receiving the dome, the base including a plateau; and a lock assembly for releasably coupling the dome of the telecommunications enclosure to the base of the telecommunications enclosure, the lock assembly coupled to the dome of the telecommunications enclosure, the lock assembly comprising a housing having a base, a cover coupled to the base of the housing, and a platform extending from the base of the housing on a side opposite the cover, the platform configured to receive at least one secondary locking device and/or at least one security device, a slider disposed at least partly within the housing and moveable between an extended position for coupling the dome of the telecommunications enclosure to the base of the telecommunications enclosure and a retracted position for uncoupling the dome from the base, and a cam configured to rotate and move the slider between the retracted position and the extended position, wherein the platform of the housing is configured to align with the plateau of the base such that the platform and the plateau extend in substantially parallel planes so that the at least one secondary locking device and/or the at least one security device, when received by the platform, can be used to help couple and/or secure the dome of the telecommunications enclosure to the base of the telecommunications enclosure.

21. The telecommunications enclosure of claim 20, wherein the plateau defines an opening configured to receive the at least one secondary locking device and/or the at least one security device, wherein the platform defines an opening configured to receive the at least one secondary locking device and/or the at least one security device, wherein the opening of the platform is configured to align with the opening of the plateau.

22. The telecommunications enclosure of claim 20, wherein the housing includes at least one stop and wherein the cam includes at least one protrusion configured to engage the at least one stop of the housing to limit rotation of the cam.

23. The telecommunications enclosure of claim 22, wherein the at least one stop includes a flange extending generally orthogonally away from the housing.

24. The telecommunications enclosure of claim 23, wherein the flange of the at least one stop is arcuate in shape and has an angular distance of about ninety degrees.

25. The telecommunications enclosure of claim 22, wherein the at least one stop of the housing includes two stops each including a flange extending generally orthogonally away from the housing, and wherein each flange is arcuate in shape and has an angular distance of about ninety degrees.

26. The telecommunications enclosure of claim 25, wherein the housing defines two channels extending between the flanges of the two stops, wherein each channel is arcuate in shape and has an angular distance of about ninety degrees, wherein the at least one protrusion includes two protrusions, and wherein one of the two protrusions moves within one of the two channels and the other of the two protrusions moves within the other of the two channels when moving the slider between the retracted position and the extended position.

27. The telecommunications enclosure of claim 20, wherein the lock assembly includes a shroud coupled to the base of the housing.

28. The telecommunications enclosure of claim 19, wherein the base including a plateau, wherein the housing includes a platform extending from the housing and configured to receive at least one secondary locking device and/or at least one security device, and wherein the platform of the housing is configured to align with the plateau of the base such that the platform and the plateau extend in substantially parallel planes so that the at least one secondary locking device and/or the at least one security device, when received by the platform, can be used to help couple and/or secure the dome of the telecommunications enclosure to the base of the telecommunications enclosure.

29. The telecommunications enclosure of claim 13, wherein the base including a plateau, wherein the housing includes a platform extending from the housing and configured to receive at least one secondary locking device and/or at least one security device, and wherein the platform of the housing is configured to align with the plateau of the base such that the platform and the plateau extend in substantially parallel planes so that the at least one secondary locking device and/or the at least one security device, when received by the platform, can be used to help couple and/or secure the dome of the telecommunications enclosure to the base of the telecommunications enclosure.

* * * * *